US005155921A

United States Patent [19]

Banike

[11] Patent Number: 5,155,921

[45] Date of Patent: Oct. 20, 1992

[54] IMAGE PLATE MOUNTING AND POSITIONING DEVICE FOR GAPLESS MAGNETIC PLATE CYLINDERS

[75] Inventor: Ronald A. Banike, Orland Park, Ill.

[73] Assignee: R. R. Donnelley & Sons Company, Lisle, Ill.

[21] Appl. No.: 733,861

[22] Filed: Jul. 22, 1991

[51] Int. Cl.[5] ..... B41F 27/00; B41B 11/00

[52] U.S. Cl. ..... 33/618; 33/623

[58] Field of Search ..... 33/614, 618, 623, 617, 33/621, 620, 619; 101/DIG. 36

[56] References Cited

U.S. PATENT DOCUMENTS

| | | | |
|---|---|---|---|
| 2,711,691 | 6/1955 | Leavens | 33/618 X |
| 4,446,625 | 5/1984 | Hagan et al. | 33/621 |
| 4,743,324 | 5/1988 | Boyce et al. | 33/621 X |

*Primary Examiner*—Harry N. Haroian

*Attorney, Agent, or Firm*—Wood, Phillips, VanSanten, Hoffman & Ertel

[57] ABSTRACT

A portable table assembly for facilitating initial alignment in mounting of a metallic printing plate to a magnetic plate cylinder includes a table having a top surface for supporting the metallic printing plate. A roller is mounted in the table and is exposed on the top surface for guiding the metallic printing plate along the top surface. The roller has an axis perpendicular to a line defined by a direction the metallic printing plate moves when mounting the metallic printing plate from the top surface onto the magnetic plate cylinder. An arcuate bracket is mounted to a bottom side of the table and supports the top surface at a tangent to the plate cylinder with an upper edge of the table resting on the plate cylinder. The bracket engages a locating cylinder having an axis substantially parallel to the magnetic plate cylinder and lying adjacent to the magnetic plate cylinder.

17 Claims, 6 Drawing Sheets

Fig. 3A
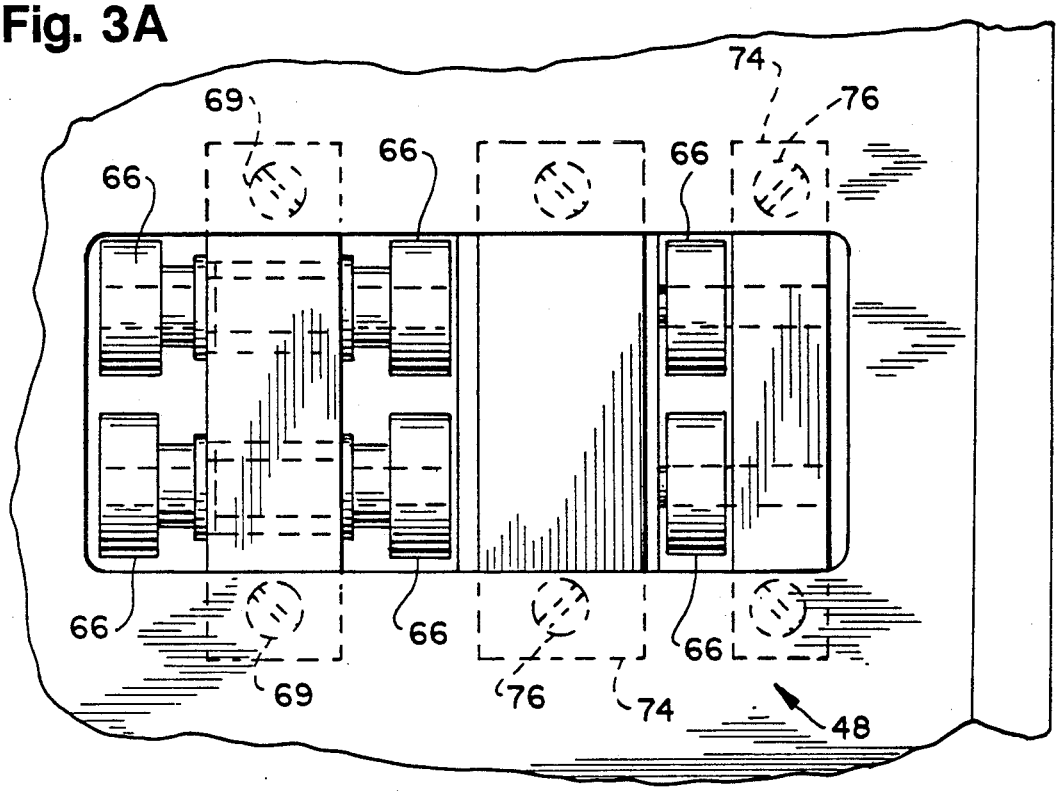
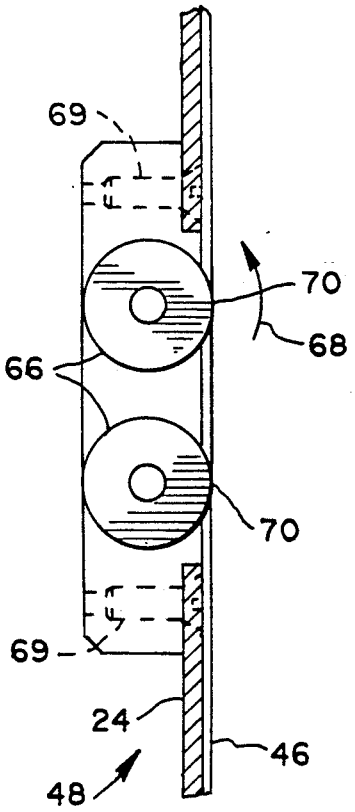
Fig. 3B

IMAGE PLATE MOUNTING AND POSITIONING DEVICE FOR GAPLESS MAGNETIC PLATE CYLINDERS

FIELD OF THE INVENTION

The present invention relates to a device for mounting and positioning in register a printing plate relative to a printing cylinder and, more specifically, to a portable support table for facilitating initial alignment and mounting of a metallic printing plate to a magnetic plate cylinder.

BACKGROUND OF THE INVENTION

Printing presses can feature a magnetic cylinder for supporting a metallic printing plate. The magnetic cylinder holds the printing plate having an image to be printed. The plate cylinder receives ink from a set of inking cylinders mounted adjacent thereto and transfers the ink to a blanket cylinder. The blanket cylinder then transfers the ink to paper. Mounting the metallic printing plate on the magnetic plate cylinder is difficult and problems are often encountered. Particularly, it is necessary that the printing plate be properly oriented when mounted on the plate cylinder. Mounting is typically done manually by an operator aligning the plate with two register pins and advancing the printing plate onto the plate cylinder by rotating the plate cylinder. The magnetic attraction of the plate cylinder draws the metallic printing plate onto the cylinder. However, the magnetic force of the plate cylinder can pull the metallic printing plate when the metallic printing plate is not aligned properly, thus making mounting in register more difficult.

The present invention provides an image plate mounting and positioning device for facilitating initial alignment and mounting of a metallic printing plate to a magnetic plate cylinder.

SUMMARY OF THE INVENTION

An object, therefore, of the invention is to provide a portable support table for facilitating initial alignment and mounting of a metallic printing plate to a magnetic plate cylinder.

In the exemplary embodiment of the invention, generally, a portable table assembly includes a table having a top surface for supporting the metallic printing plate. A row of rollers is mounted to the table and is exposed on the top surface. The rollers guide the metallic printing plate along the top surface. The rollers have an axis perpendicular to a line defined by a direction the metallic printing plate moves when mounting the metallic printing plate from the top surface onto the magnetic plate cylinder. A means is provided for resting the table in a position adjacent the magnetic plate cylinder.

The invention also contemplates providing the roller with a clutch means for allowing rotation only in the direction towards the magnetic plate cylinder when the table is positioned relative to the plate cylinder.

A further feature of the invention is the provision of a set of magnetic plates mounted adjacent the rollers on the top surface for holding the metallic printing plate against the roller.

A further feature of the invention is a provision of the resting means including an arcuate bracket means mounted to a bottom side of the table assembly for supporting the top surface at a tangent to the plate cylinder with an upper edge of the table resting on the plate cylinder. The bracket means engages a locating cylinder having an axis substantially parallel to the magnetic plate cylinder and lying adjacent to the magnetic plate cylinder.

Still another novel feature of the invention is the provision of a layer of nonmagnetic material having a low coefficient of friction mounted on a portion of the top surface of the table for easing the sliding friction between the metallic printing plate and the table as well as to attenuate the magnetic attractive force of the magnetic plate cylinder next to the lead edge of the table.

Other objects, features and advantages of the invention will be apparent from the following detailed description taken in connection with the accompanying drawings.

BRIEF DESCRIPTION OF THE DRAWINGS

FIG. 3A is a top view of the magnetic hold/clutch-roller assembly;

FIG. 3B is a side view of the magnetic hold/clutch-roller assembly;

DETAILED DESCRIPTION OF THE PREFERRED EMBODIMENT

Figure 1:
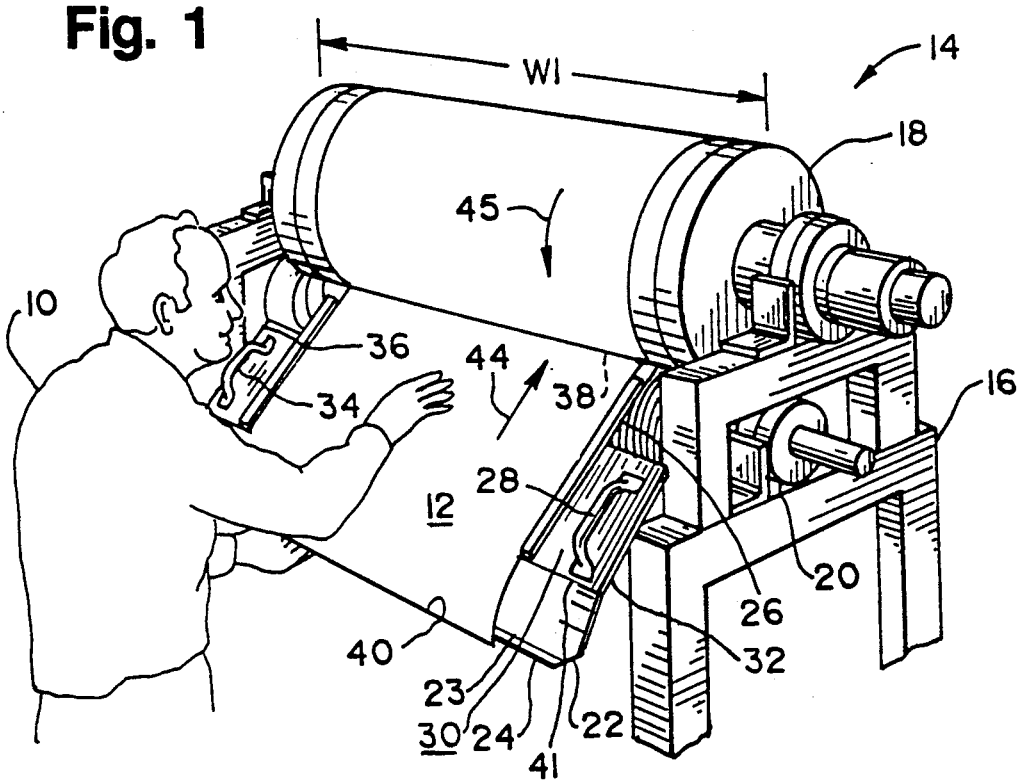
FIG. 1 is a perspective view of an operator mounting a printing plate onto a mock-up printing press using a portable table assembly according to the present invention.

FIG. 1 shows an operator 10 mounting a metallic printing plate 12 onto a mock-up printing press 14. The mock-up printing press 14 includes a frame 16 supporting a blanket cylinder 18 and a magnetic plate cylinder 20. While the present invention is illustrated using a mock-up printing press 14, it should be understood that the invention operates with a conventional printing press as described below in conjunction with FIGS. 4–7.

The printing plate 12 is supported by a portable table assembly 22 which facilitates initial alignment and mounting of the metallic printing plate 12 to the magnetic plate cylinder 20. The portable table assembly 22 includes a first rectangular portion 24 having a width approximately equal to a width W1 of the blanket cylinder 18 and magnetic plate cylinder 20. The portable table assembly 22 includes a second rectangular portion 26 having a width slightly greater than a width of the printing plate 12. The table 22 includes a first handle 28 mounted on a top surface 30 thereof adjacent a lateral edge 32 and a second handle 34 mounted on the top surface 30 of the first portion 24 adjacent an opposite lateral edge 36 thereof.

The printing plate 12 typically includes precurved leading and trailing edges 38, 40, respectively. The table 22 includes a bend 41 adjacent a lower edge 42 of the first rectangular portion 24. The bend 41 provides clearance for the precurved trailing edge 40 of the printing plate 12. The leading edge 38 on the plate cylinder 20 is partially mounted in FIGS. 1 and 2 and thus cannot be seen. However, the leading edge 38 can be seen in FIG. 4. The precurved leading and trailing edges 38, 40, respectively, allow the printing plate 12 to readily conform to the cylindrical plate cylinder 20.

The printing plate 12 is drawn onto the plate cylinder 20, as shown by arrow 44, when the operator 10 lightly pushes the printing plate 12 against the two register pins (at 100 in FIGS. 4 and 6) located in the plate cylinder 20 as the cylinder is slowly rotated at inching speed. The blanket cylinder 18 rotates in a direction defined by an arrow 45 and the plate cylinder 20 rotates in a direction opposite to the arrow 45.

Figure 2:
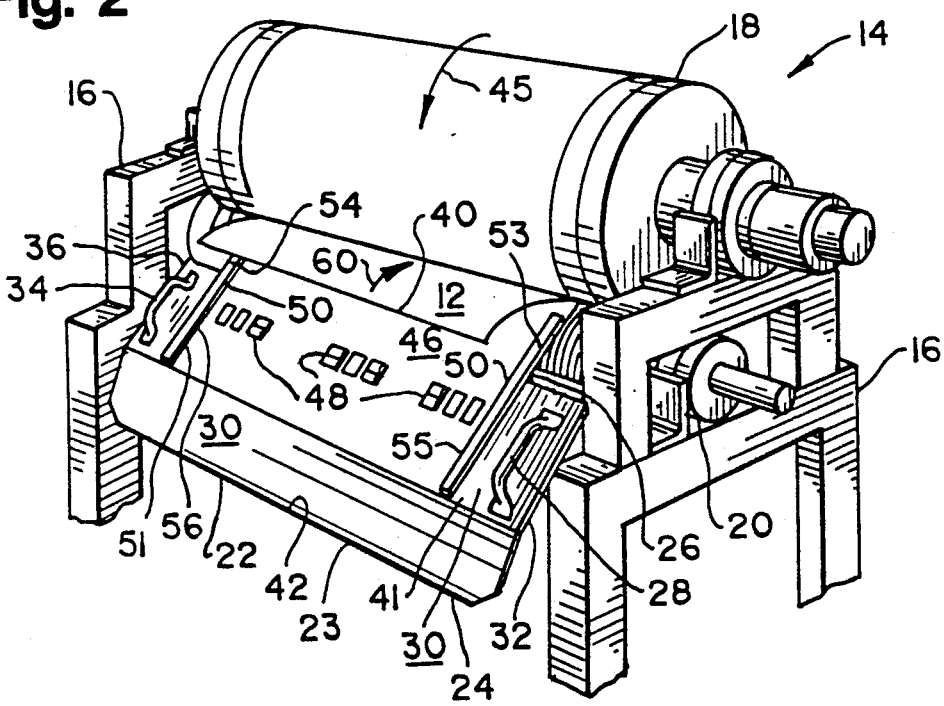
FIG. 2 shows the perspective view of FIG. 1 with the printing plate partially advanced onto the magnetic plate cylinder.

FIG. 2 shows the printing press mock-up 14 of FIG. 1 with the printing plate 12 substantially mounted and the top surface 30 of the table 22 exposed. The second rectangular portion 26 includes a layer 46 of nonmagnetic material having a low coefficient of friction for reducing the sliding friction between the metallic printing plate 12 and the table 22, as well as to attenuate the magnetic attractive force of the plate cylinder. The layer 46 is preferably, but not necessarily, made from a thin layer of "Teflon". The layer 46 has a width approximately equal to the second rectangular portion 26 and extends onto the first rectangular portion 24. The layer 46 extends beyond the second rectangular portion 26 onto the plate cylinder 20. The layer 46 may include perforations (not shown) to increase the flexibility of the layer 46.

First and second elongate metal strips 50, 51, respectively, fasten the layer 46 to the top surface. The first and second metal strips 50, 51, respectively are fastened to the table using a fastener 52, such as sheet metal screws (not show in FIGS. 1 and 2, but shown in FIGS. 4–7). The first elongate strip 50 is located along a lateral edge 53 of the second rectangular portion 26 and extends onto the first rectangular portion 24. The second elongate strip 51 is located along a lateral edge 54 of the second rectangular portion 26 and extends onto the first rectangular portion 24. Inner edges 55, 56 of the first and second elongate metal strips 50, 51, respectively, can be used to guide the printing plate as it is pushed onto the plate cylinder 20. Alternatively, layer 46 could be attached to the top surface 30 of the table 22 using adhesive.

The portable table assembly 22 also includes magnetic hold/clutch-roller assembly 48 mounted in the top surface 30 thereof. The magnetic hold/clutch-roller assembly 48 attracts the metallic printing plate 12 to the top surface 30 and allows the metallic printing plate 12 to move only in a direction defined by an arrow 60. Magnetic hold/clutch-roller assembly 48 will be described in greater detail below in conjunction with FIGS. 3A and 3B.

FIGS. 3A and 3B are an enlarged top view and side view, respectively, of the magnetic hold/clutch-roller assembly 48. Magnetic hold/clutch-roller assembly includes one-way clutch-rollers 66 which lock in a direction indicated by arrow 68 and are flush mounted to the first rectangular portion 24 using fasteners 69, for example sheet metal screws. Preferably an outer circumference 70 of the rollers 66 is rubber coated to increase frictional contact with the printing plate 12. Rollers 66 extend slightly beyond the layer 46 to positively contact the printing plate 12 when the printing plate 12 is supported on the table 22. To increase the contact between the rollers 66 and the printing plate 12, magnetic hold plates 74 are mounted on the rectangular portion 24, preferably co-planar with the layer 46 to maximize the magnetic attraction of the plates 74. The plates 74 are held to the first rectangular portion with fasteners 76, for example sheet metal screws.

Figure 4:
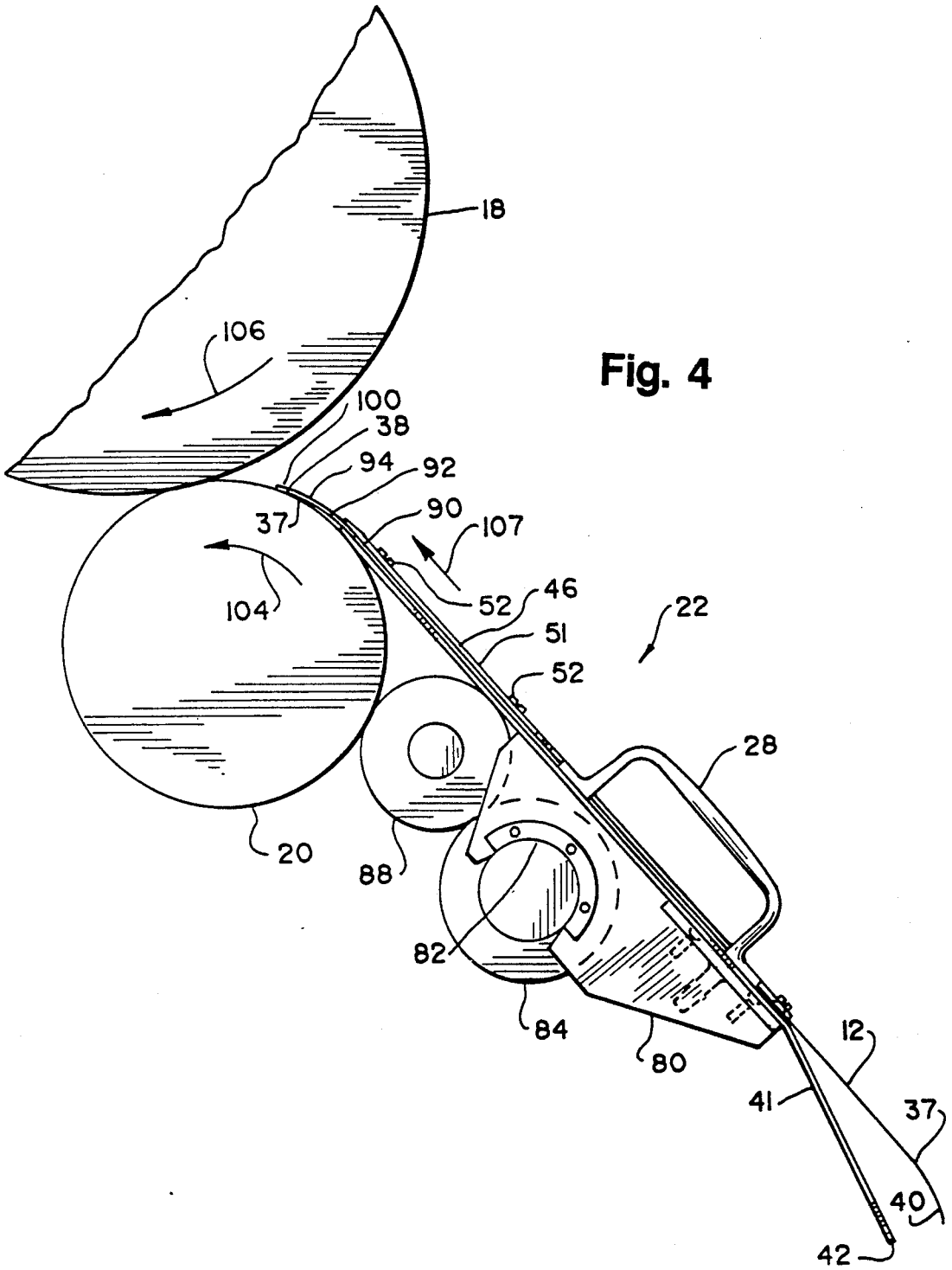
FIG. 4 is a side view of the portable table assembly mounting a printing plate onto a lower magnetic plate cylinder.
Figure 5:
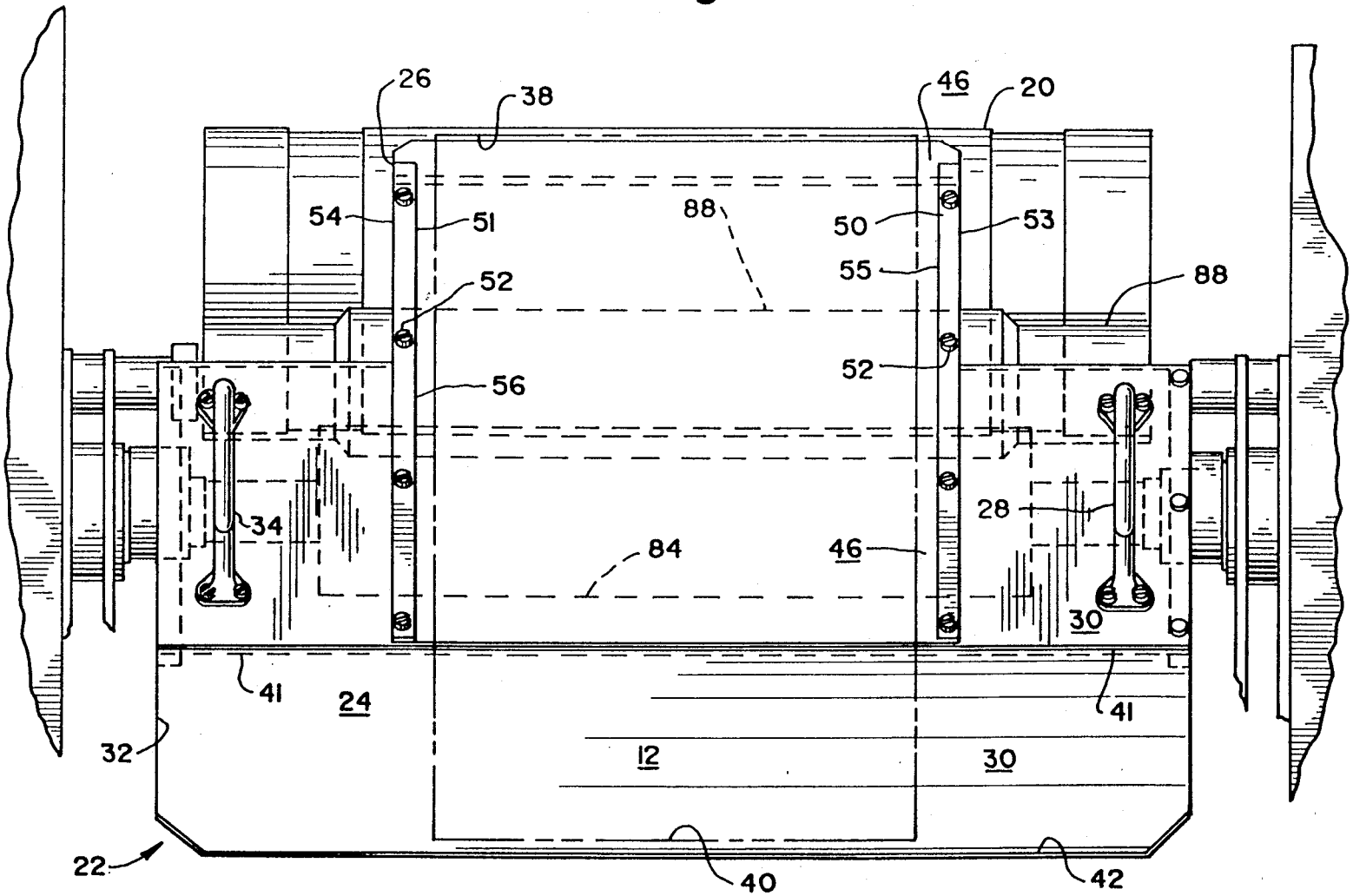
FIG. 5 is a top view of the portable table assembly in FIG. 4.

FIGS. 4 and 5 show a side view and top view of the portable table assembly 22 shown in FIGS. 1 and 2. The portable table assembly 22 includes an arcuate bracket 80 having an arcuate guide 82 resting on a locating cylinder 84 also known as a vibrating cylinder, as best seen in FIG. 5. The arcuate bracket 80 positions the portable table assembly 22 at a tangent to the magnetic plate cylinder 20 below the blanket cylinder 18. Alternatively, the arcuate bracket 80 could rest on a form cylinder 88 or another structure in the vicinity, such as the frame 16, however, the arcuate bracket 80 would need to be mounted in a different position than shown in FIG. 5 to support the plate 12 in an orientation shown in FIG. 4.

The metallic printing plate 12 is mounted on the magnetic plate cylinder 20 in the following fashion:

The portable table assembly 22 carried by handles 28, 34 is positioned with the arcuate bracket 80 and arcuate guide 82 located over the locating cylinder 84. An upper edge 90 of the second rectangular portion 26 is rested against the magnetic plate cylinder 20. The layer 46 extends beyond the second rectangular portion at 92 allowing only a small portion 94 of the leading edge 38 of the printing plate 12 to extend beyond and be placed in magnetic attraction with the magnetic plate cylinder 20. The printing plate 12 is laid onto the table 22 so that the precurved leading and trailing edges 38, 40, respectively, bend downward. The operator 10 then aligns the printing plate 12 with the magnetic plate cylinder 20 using register pins 100 to align the leading edge 38 of the printing plate 12 to the magnetic plate cylinder 20. The operator 10 pushes the printing plate 12 against the register pins 100, causing the magnetic plate cylinder 20 and blanket cylinder 18 to rotate in a direction defined by arrows 104,106, respectively, drawing the printing plate 12 onto the plate cylinder 20 in a direction defined by arrow 107. Once the printing plate 12 is mounted, the operator 10 can easily remove the portable table 22 using the handles 28 and 34.

Figure 6:
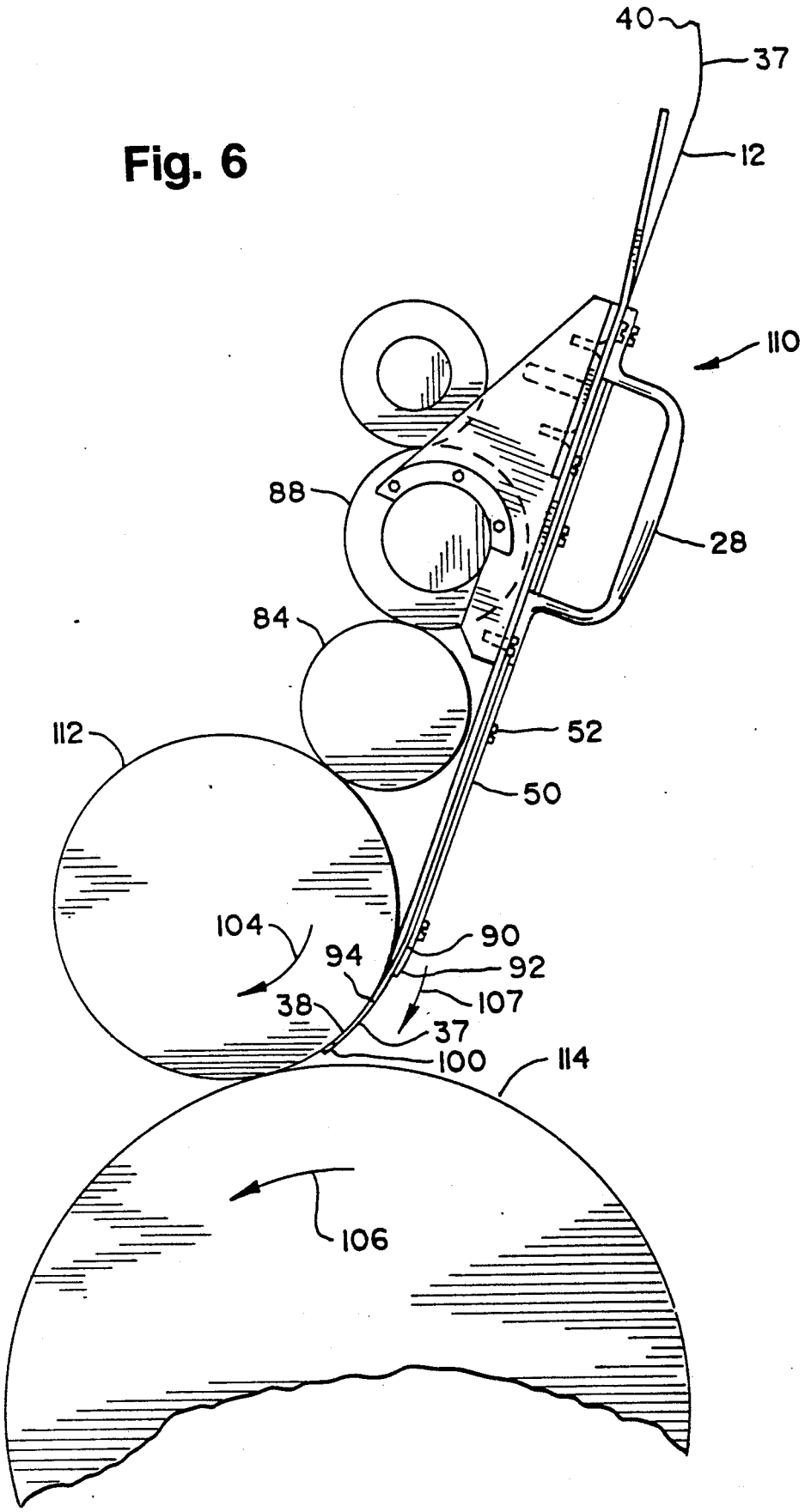
FIG. 6 is a side view of a portable table assembly mounting a printing plate on an upper magnetic plate cylinder.
Figure 7:
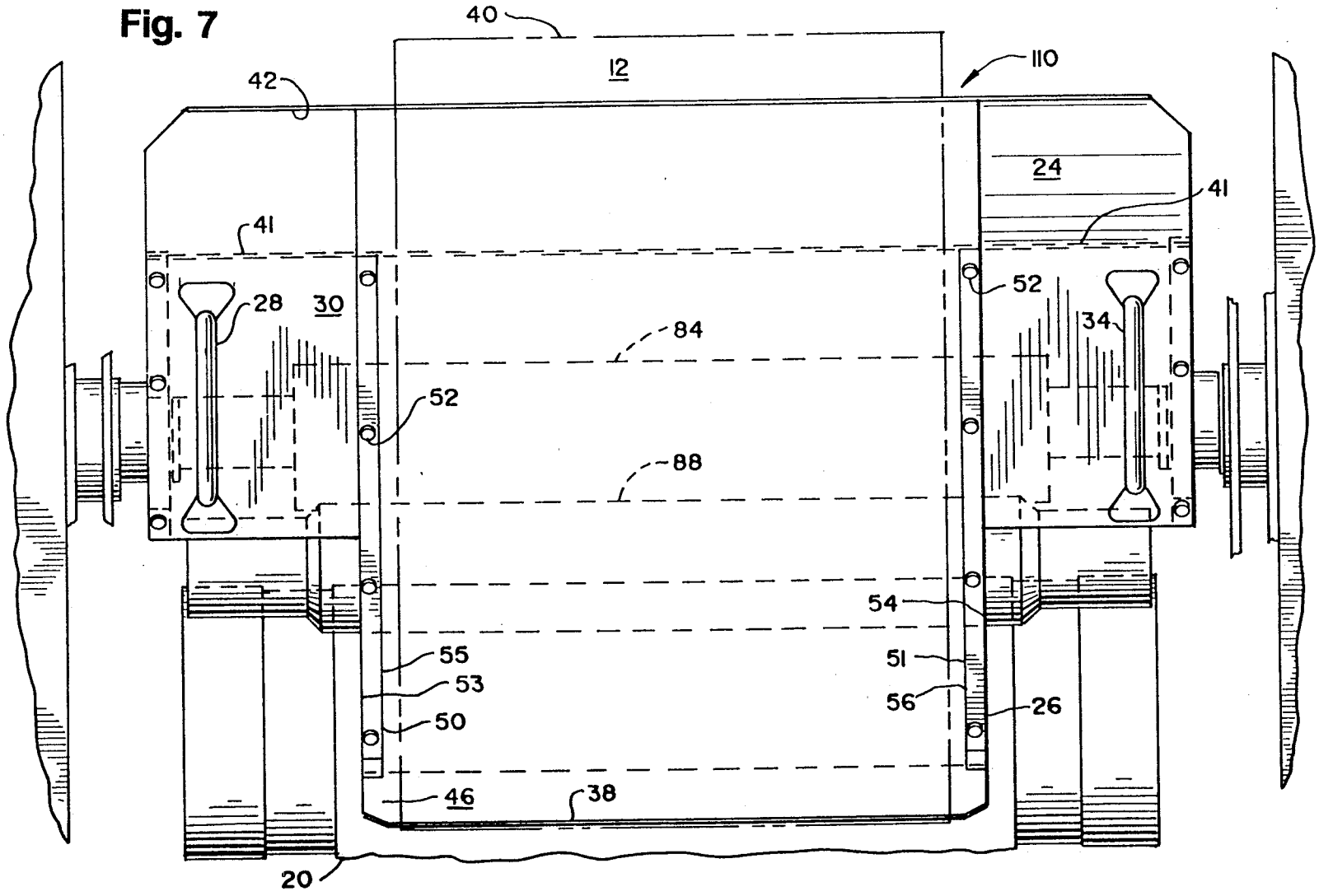
FIG. 7 is a top view of the portable table assembly table of FIG. 6.

A printing press for printing both sides of the paper includes upper and lower sets of blanket cylinders and plate cylinders. FIGS. 4 and 5 show the table 22 for lower blanket cylinders and plate cylinders. FIGS. 6 and 7 show a portable table assembly 110 for mounting a metallic printing plate onto an upper magnetic plate cylinder 112 adjacent an upper blanket cylinder 114. The table 110 shown in FIGS. 6 and 7 is similar to that shown in FIGS. 4 and 5 and, in the interest of brevity, the description will not be repeated with respect to elements that are similar. The table 110 in FIGS. 6 and 7 includes a modified arcuate bracket 120 having an arcuate guide 122. The arcuate guide 122 is rotated approximately 90° relative to the arcuate guide 82 shown in FIG. 4. The arcuate bracket 120 engages the locating cylinder 88 to support the table 110 at a tangent to the upper plate cylinder 112 and adjacent and above the upper blanket cylinder 114. In this case, the magnetic hold/roller clutch assembly 48 magnetically attracts the magnetic printing plate 12 which would otherwise fall from the portable support table 110 due to the force of gravity. The magnetic hold/ roller-clutch assembly 48 is not shown in FIGS. 4–7.

It will be understood that the invention may be embodied in other specific forms without departing from the spirit or essential characteristics thereof. The present examples are in embodiments, therefore, they are to be considered in all respects as illustrative and not restrictive, and the invention is not to be limited to the details given herein.

I claim:

1. A portable table assembly for facilitating initial alignment and mounting of a metallic printing plate to a magnetic plate cylinder comprising:

a table having a top surface for supporting the metallic printing plate;

a roller means mounted to the table and exposed on the top surface for guiding the metallic printing plate along the top surface, the roller-having an axis perpendicular to a line defined by a direction the metallic printing plate moves when mounting the metallic printing plate from the top surface onto the magnetic plate cylinder; and a means for resting the table in a position adjacent the magnetic plate cylinder.

2. The portable table assembly of claim 1 wherein the roller includes a clutch means for allowing rotation only in the direction towards the magnetic plate cylinder when the table is positioned relative to the plate cylinder.

3. The portable table assembly of claim 1 further including a magnetic holding means mounted adjacent the roller means for magnetically attracting the printing plate against the roller means.

4. The portable table assembly of claim 1 includes an arcuate bracket means mounted to a bottom side of the table for supporting the top surface at a tangent to the plate cylinder with an upper edge of the table resting on the plate cylinder, the bracket means engaging a locating cylinder having an axis substantially parallel to the magnetic plate cylinder and lying adjacent to the magnetic plate cylinder.

5. The portable table assembly of claim 1 further including a layer of nonmagnetic material having a low coefficient of friction mounted on a portion of the top surface of the table for easing sliding friction between the metallic printing plate and the table and for attenuating magnetic attraction between the metallic printing plate and the magnetic plate cylinder to ease the alignment of the printing plate.

6. The portable table assembly of claim 5 wherein the portion has a width approximately equal to a width of the printing plate.

7. The portable table assembly of claim 5 wherein the layer is "Teflon".

8. The portable table assembly of claim 5 wherein the layer is attached to the surface using adhesive.

9. The portable table assembly of claim 5 wherein the portion is slightly wider than the printing plate and the layer is mounted to the surface using first and second elongate metal strips fastened to opposite lateral edges of the layer and extending beyond opposite lateral edges of the printing plate.

10. The portable table assembly of claim 1 wherein a leading edge of the metallic printing plate is aligned with the magnetic plate cylinder by at least two registering pins.

11. The portable table assembly of claim 1 further including a first handle mounted on the top surface adjacent a lateral edge and a second handle mounted on the top surface adjacent an opposite lateral edge.

12. The portable table assembly of claim 3 wherein the locating cylinder is a vibration cylinder which rotatably contacts a form cylinder which in turn rotatably contacts the plate cylinder.

13. A portable table assembly for facilitating initial alignment and mounting of a metallic printing plate to a magnetic plate cylinder comprising:

a table having a top surface; and an arcuate bracket means mounted to a bottom side of the table for supporting the top surface at a tangent to the plate cylinder, the bracket means engaging a locating cylinder having an axis substantially parallel to the plate cylinder and lying adjacent the plate cylinder.

14. A portable table assembly for aligning and mounting a metallic printing plate having a width on a magnetic plate cylinder having an axial length comprising:

a table having a top surface including a first rectangular portion having a width approximately equal to the axial length of the plate cylinder and a second rectangular portion extending from an upper edge of the first portion, the second portion having a width approximately equal to a width of the printing plate; and an arcuate bracket means mounted to a bottom side of the table for supporting the top surface of the table at a tangent to the plate cylinder with the upper edge of the second portion resting on the plate cylinder, the bracket means engaging a locating cylinder having an axis substantially parallel to the plate cylinder and lying adjacent the magnetic plate cylinder.

15. A portable table assembly for aligning and mounting a metallic printing plate on a magnetic plate cylinder having an axial length comprising:

a table having a top surface including a first rectangular portion having a width approximately equal to the axial length of the plate cylinder and a second rectangular portion mounted to and extending from an upper edge of the first portion, the second portion having a width approximately equal to a width of the printing plate; and a first handle mounted on the top surface of the first portion adjacent a lateral edge thereof and a second handle mounted on the top surface of the first portion adjacent an opposite lateral edge thereof.

16. A portable table assembly for aligning and mounting a metallic printing plate on a magnetic plate cylinder having an axial length comprising:

a table having a top surface including a first rectangular portion having a width approximately equal to the axial length of the plate cylinder;

a second rectangular portion extending from an upper edge of the first portion, the second portion having a width approximately equal to the width of the printing plate; and a magnetic hold/clutch roller means mounted to the table and exposed on the top surface for holding the metallic printing plate against the top surface of the first and second portions, the magnetic hold/-clutch roller means including a magnetic plate mounted adjacent a roller, the roller having an axis substantially perpendicular to a line defined by a direction the metallic printing plate moves when mounting the metallic printing plate onto the magnetic printing cylinder.

17. A portable table assembly for aligning and mounting a metallic printing plate on a magnetic plate cylinder having an axial length comprising:

a table having a top surface including a first rectangular portion having an upper edge and a width approximately equal to the axial length of the plate cylinder; and a layer of nonmetallic material mounted to the top surface and extending beyond the upper edge onto the magnetic plate cylinder for easing the sliding friction between the metallic printing plate and the table and for attenuating magnetic attraction between the magnetic plate cylinder and metallic printing plate to ease the alignment of the printing plate.

* * * * *